US005231389A

United States Patent [19]

Yamauchi

[11] Patent Number: 5,231,389

[45] Date of Patent: Jul. 27, 1993

[54] DISPLAY CONTROL FOR SELECTING OSCILLATING SIGNALS

[75] Inventor: Takeshi Yamauchi, Itami, Japan

[73] Assignee: Mitsubishi Denki Kabushiki Kaisha, Tokyo, Japan

[21] Appl. No.: 818,059

[22] Filed: Jan. 8, 1992

[30] Foreign Application Priority Data

Jan. 30, 1991 [JP] Japan ..... 3-9458

[51] Int. Cl.[5] ..... G09G 3/00

[52] U.S. Cl. ..... 340/814; 331/49; 331/46

[58] Field of Search ..... 340/814, 717; 358/160, 358/140, 150; 375/118; 331/49, 55, 46

[56] References Cited

U.S. PATENT DOCUMENTS

| | | | |
|---|---|---|---|
| 3,594,656 | 7/1971 | Tsukamoto | 331/49 |
| 4,419,429 | 12/1983 | O'Brien | 331/49 |
| 4,686,567 | 8/1987 | Burdick | 358/148 |
| 4,916,442 | 4/1990 | Kim | 340/814 |
| 5,089,793 | 2/1992 | Nagao | 331/49 |

*Primary Examiner*—Tommy Chin
*Assistant Examiner*—A. Au
*Attorney, Agent, or Firm*—Morrison Law Firm

[57] ABSTRACT

A display control apparatus includes a display control block with plural external connector terminals, and an oscillator block including plural oscillators. The external connector terminals are coupled to a selector for selecting one of the terminals in response to a selection signal applied thereto, with the output of the selector connected to the internal display control circuit via a second gate. A predetermined one of the terminals is coupled via a first gate to the internal display control circuit. The selection signal is coupled to the external connector terminals other than the predetermined terminal via a third gate. When the oscillator block of one type is used, the apparatus operates in a first operating mode, in which the first and third gates are closed and the second gate is opened, and when the oscillator block is of another type, the apparatus operates in a second mode in which the first and third gates are opened and the second gate is closed.

4 Claims, 4 Drawing Sheets

DISPLAY CONTROL FOR SELECTING OSCILLATING SIGNALS

This invention relates to a display control apparatus for controlling display devices, such as a cathode ray tube and a liquid crystal display panel, of a computer system and the like and, more particularly, to such an apparatus for selectively providing clock signals at different frequencies depending on types of display devices used.

BACKGROUND OF THE INVENTION

Depending on the types and manufacturers, display devices are driven by clock signals of different frequencies. Accordingly, it is desirable that display control apparatus for computer systems and the like be capable of selectively providing a plurality of clock signals of different frequencies so that the apparatus can be used with different types of display devices.

A conventional general-purpose display control apparatus comprises an oscillator block and a display control block. The oscillator block includes a plurality of normally oscillating oscillators, and the display control block has a selector for selecting only one of the oscillation signals from the oscillators that is designated by a command signal. The display control block also includes, in addition to the selector, various circuits for operating display devices.

In general, the display control block is fabricated in a single integrated circuit, but it is difficult to assemble the oscillators in the display control block. Therefore, the oscillator block is usually coupled by appropriate connector means to external connector terminals provided on the display control block. To provide a number of external connector terminals on an integrated circuit is restricted due to technical reasons and, therefore, the number of oscillators which can be coupled to the display control block is also restricted. Accordingly, it is apparent that if the number of external connector terminals which can be provided on the display control block is, for example, four, only four different clock signals can be selected.

A first object of the present invention is to provide a display control apparatus including a display control block which can selectively provide a greater number of different clock signals than a relatively small number of external connector terminals on the display control block provided for connection to an oscillator block. Thus, the oscillator block can include a greater number of oscillators than the number of the external connector terminals of the display control block.

A second object of the present invention is to provide such a display control apparatus as stated above in which power consumption and heat generation in the oscillator block are suppressed. If all of the oscillators in the oscillator block are simultaneously in an operating state, power consumed in the oscillator block will be greater as the number of the oscillators increases and the amount of heat generated also increases accordingly. This is disadvantageous when the system is to be formed compact. Suppression of power consumption and generation of heat in the oscillator block is achieved by operating the only oscillator which generates a clock signal at a selected frequency and supplying no operating current to the other oscillators.

Another object of the present invention is to provide a display control apparatus including a general-purpose display control block to which not only the above-described oscillator block including a greater number of oscillators than the number of external connector terminals of a display control block, but also a conventional oscillator block including the same number of oscillators as the external connector terminals on the display control block can be connected, and in which proper operation of the display control block can be achieved by simply switching an operating mode of the display control block.

SUMMARY OF THE INVENTION

A display control apparatus according to the present invention can selectively provide a plurality of clock signals at different frequencies to control a desired one of a plurality of display devices operating at different clock signal frequencies. The display control apparatus of the present invention comprises a display control block having a plurality of external connector terminals, and an oscillator block including connector means to be connected to the respective ones of the external connector terminals of the display control block and a plurality of oscillators oscillating at different oscillation frequencies. The display control block includes first gating means for coupling a predetermined one of the external connector terminals to an internal display control circuit in the display control block, means for generating an oscillator selection signal in a binary form for selecting one of the oscillators, a selector coupled to the external connector terminals for selecting one of the external connector terminal corresponding to the selection signal supplied thereto from the selection signal generating means, second gating means for coupling the external connector terminal selected by the selector to the internal display control circuit, third gating means for coupling the selection signal to the remaining ones of the external connector terminals, and gate control means for controlling the gating operation of the respective gating means. In a first mode of operation, the gate control means closes the first and third gating means and opens the second gating means, whereas, in a second mode of operation, it opens the first and third gating means and closes the second gating means.

The oscillator block coupled to the display control block may be similar to a conventional one, and includes a plurality of normally oscillating oscillators having their respective outputs coupled to the connector means. When such an oscillator block is connected, the respective gating means in the display control block are controlled to the first mode of operation.

The oscillator block may comprise a plurality of normally oscillating oscillators, and a oscillator selector for selecting one of said oscillators and supplying the oscillation signal thereof to the connector means corresponding to the predetermined one of the external connector terminals. The oscillator selection signal for causing the selecting operation of said oscillator selector is supplied to the oscillator selector through the remaining one of the external connector terminals and the connector means associated therewith. When this type of oscillator block is connected, the respective gating means of the display control block are placed in the second mode of operation.

Still another type of oscillator block may be used, which includes an oscillator selector disposed between a operating power supply and the oscillators. Only one of the oscillators is selected by the oscillator selector and receives operating current from the power supply for oscillation. Outputs of all of the oscillators are coupled to the connector means corresponding to the predetermined one of the external connector terminals of the display control block. The oscillator selection signal is applied to the oscillator selector through the remaining external connector terminals and their associated connector means so as to cause the oscillator selector to perform the desired selecting operation. When this type of oscillator block is connected, the gating means of the display control block are placed in the second mode of operation.

DETAILED DESCRIPTION OF THE INVENTION

Figure 1:
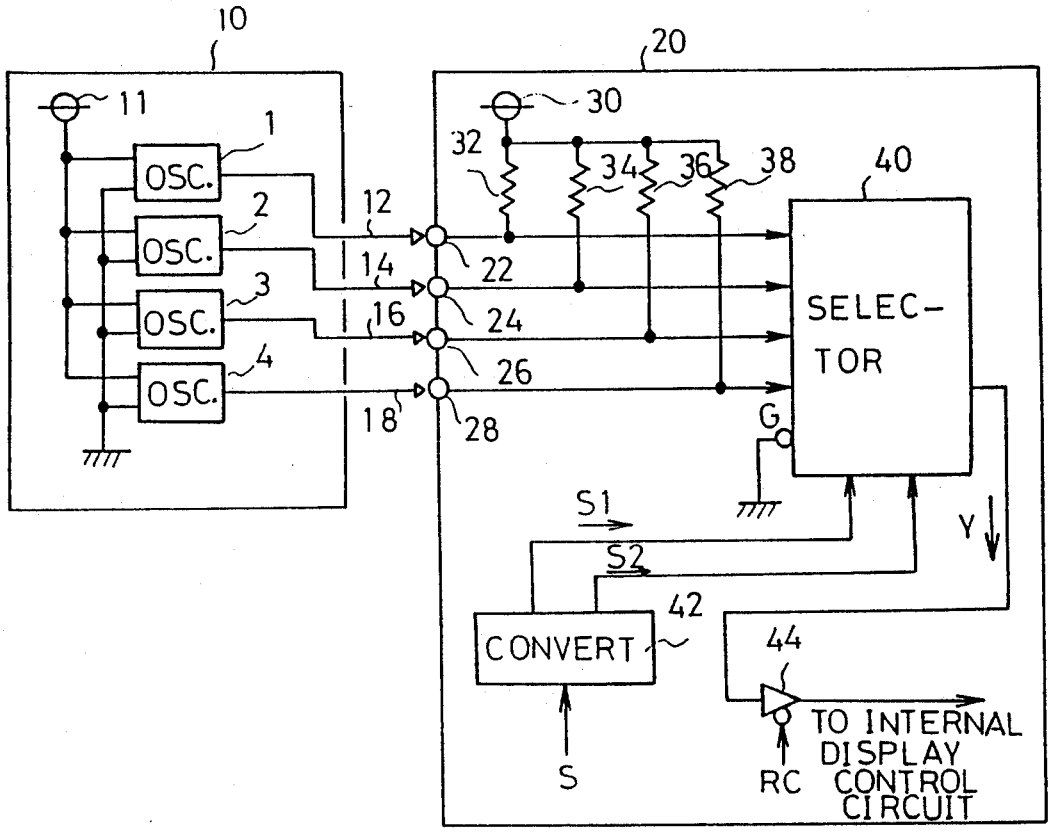
FIG. 1 PRIOR ART
FIG. 1 shows a conventional display control block and an oscillator block connected thereto.

FIG. 1 shows an example of a conventional general-purpose display control apparatus. An oscillator block 10 includes oscillators 1, 2, 3 and 4 which are normally operating from a power supply 11. A display control block 20 is provided with external connector terminals 22, 24, 26 and 28 to which clock signals generated by the oscillators 1–4 are respectively coupled via associated connector means 12, 14, 16 and 18. The display control block 20 also includes pull-up resistors 32, 34, 36 and 38 respectively connecting the external connector terminals 22–28 to a power supply 30, a selector 40 which has inputs connected to the external connector terminals 22–28, a converter circuit 42 which converts a manually or internally provided command signal S to a binary signal comprising two bits S1, S2 and applies the binary signal to the selector 40, and a three-state buffer circuit 44 responsive to a control signal RC which is internally generated and applied to the buffer circuit 44 all the time when the display system is operating. When the control signal RC at a low level is applied to the three-state buffer circuit 42, an output clock signal Y from the selector 40 is coupled to a clock input of an in internal display control circuit (not shown).

In operation, the converter circuit 42 converts the command signal S into a binary signal S1, S2. In response to the binary signal S1, S2, the selector 40 selects one of the four inputs which corresponds to the binary signal S1, S2 and couples the clock signal at the selected input to the internal display control circuit as the output Y.

This apparatus can select one of four clock signals. However, in order to widen the utility of this apparatus by arranging it to be capable of selecting one out of a larger number of clock signals, the number of external connector terminals provided in the display control block 20 must be increased. Furthermore, since the oscillators in the oscillator block 10 are operating all the time, power consumption in the display system increases as the number of selectable clock signals increases.

Figure 2:
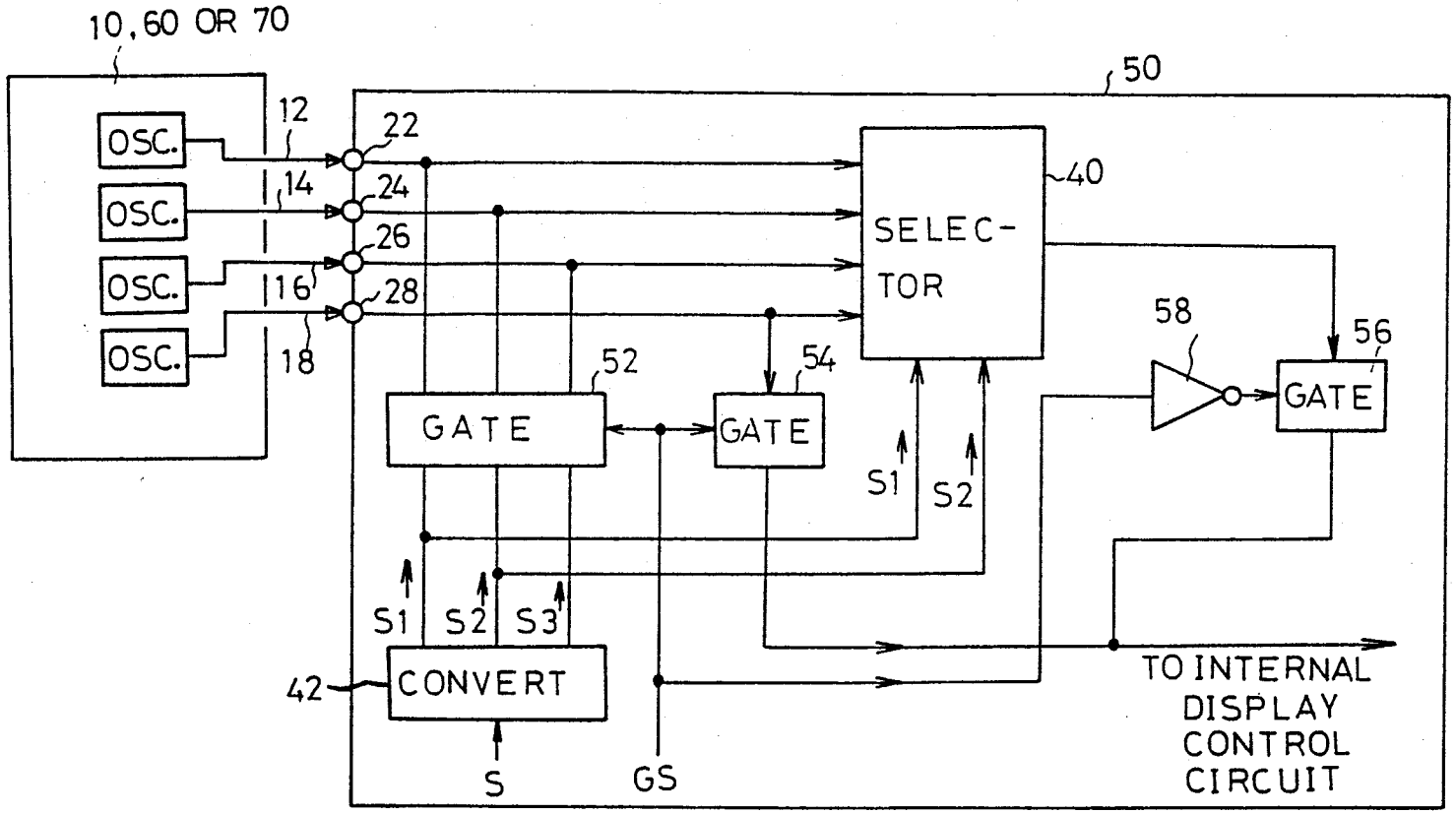
FIG. 2 is a block diagram of a display control block according to the present invention.

FIG. 2 shows the basic arrangement of a display control block of the present invention. The display control block 50 has a plurality, four in the illustrated example, of external connector terminals 22, 24, 26 and 28 to which an oscillator block 10, 60, or 70, which will be described later, is coupled via connectors 12, 14, 16 and 18, respectively. The display control block 50 is part of a display driving unit within a computer. The display control block couples a clock signal generated in the oscillator block to an internal display control circuit (not shown) within the display driving unit, and the display driving unit produces a display driving signal for driving a display device coupled to the computer.

When a different display device is connected to the computer, an externally generated command signal S for selecting a clock signal at a frequency appropriate for that display device, is applied to the display control block 50. When a different oscillator block is coupled to the block 50 via the external connector terminals 22–28, a gate control signal GS in the form of a single digit binary signal, corresponding to the oscillator block coupled, is externally generated and applied to the display control block 50. Alternatively, the gate control signal GS may be internally generated in the block 50.

The external connector terminals 22–24 are connected to the input of a selector 40. A converter circuit 42 converts the command signal S into a binary signal comprising a plurality, three in the illustrated embodiment, of binary bits S1, S2 and S3 and couples the respective bits to the external connector terminals 22, 24 and 26 through a gate 52. The bits S1 and S2 form a selection signal which is coupled to the selector 40. The external connector terminal 28 is also coupled through a gate 54 to the internal display control circuit to which the output of the selector 40 is also coupled through a gate 56.

In a first mode of operation in which the gate control signal GS is not present (i.e. GS=0), the gates 52 and 54 are closed, whereas in a second mode of operation in which the gate control signal is present (i.e. GS=1), the gates 52 and 54 are open. The gate 56 receives an inverted version of the gate control signal GS through an inverter 58 so that it is open when the display control block 50 is in the first mode of operation, i.e. in the absence of the gate control signal GS, and it is closed in the second mode of operation in which the gate control signal GS is present.

Figure 3:
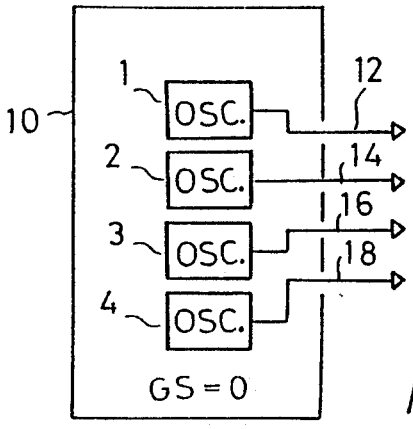
FIG. 3 PRIOR ART
FIG. 3 is a simplified block diagram of one example of oscillator block similar to the one shown in FIG. 1, which can be used with the display control block of the present invention shown in FIG. 2.

An oscillator block 10 shown in FIG. 3 is the same as the conventional one shown in FIG. 1, which can be used with the display control block 50 of the present invention shown in FIG. 2. The oscillator block 10 includes clock oscillators 1, 2, 3 and 4 coupled to connectors 12, 14, 16 and 18, respectively. The oscillators are normally operating.

Figure 4:
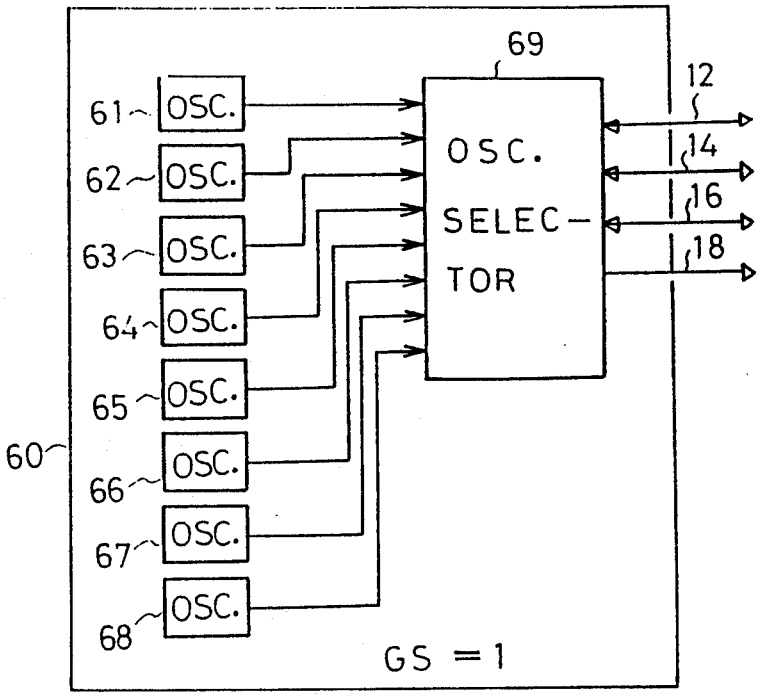
FIG. 4 is another example of oscillator block which can be used with the display control block of the present invention shown in FIG. 2.

FIG. 4 shows another type of oscillator block 60 which includes a plurality of clock oscillators 61, 62, 63, 64, 65, 66, 67, and 68. All of the oscillators are normally operating. Clock signals generated by these oscillators 61–68 are applied to an oscillator selector 69 which selects one of the clock signals in response to the binary signal S1, S2, S3 applied thereto via the connector 12, 14 and 16. The selected clock signal is coupled to the remaining connector 18.

Figure 5:
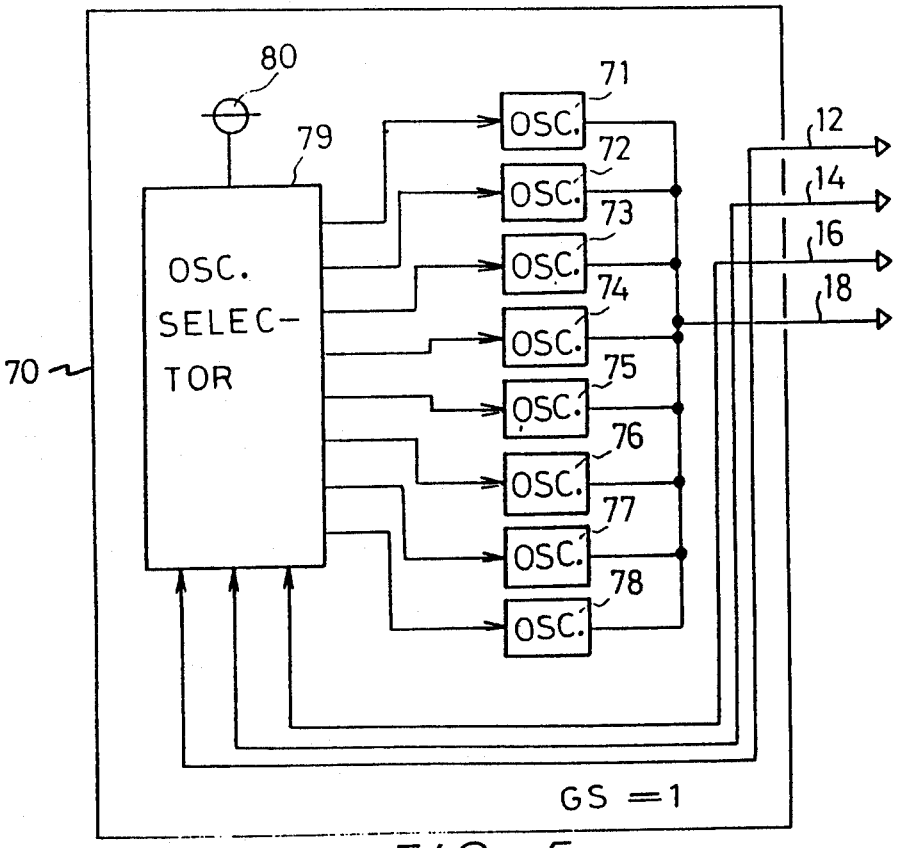
FIG. 5 is a block diagram of still another example of oscillator block which can be used with the display control block of the present invention shown in FIG. 2.

An oscillator block 70 shown in FIG. 5 includes an oscillators 71, 72, 73, 74, 75, 76, 77 and 78. A selector 79 selects one of the oscillators 71–78 in response to the binary signal S1, S2, S3 coupled to it via the connectors 12, 14 and 16, and couples the selected oscillator to a power supply 80 so that the selected oscillator can operate. The clock signal generated by the selected oscillator is coupled to the connector 18.

Referring to FIG. 2 again, when the oscillator block 10 shown in FIG. 3 is connected to the display control block 50, the gate control signal GS is not applied (i.e. GS=0). Without the gate control signal GS, the display control block operates in the first mode of operation in which the gates 52 and 54 are closed and the gate 56 is opened. When the command signal S for selecting one of the oscillators is applied, the converter circuit 42 converts the command signal S into a binary signal comprising three bits S1, S2 and S3. The selector 40 selects one of the clock signals coupled to it from the oscillator block 10 through the external connector terminals 22, 24, 26 and 28, in accordance with the combination of the bits S1 and S2. The selected clock signal is applied through the gate 56 to the internal display control circuit.

When the oscillator block 60 shown in FIG. 4 is connected to the display control block 50, the apparatus operates in the second mode and the gate control signal GS is applied, so that the gates 52 and 54 are opened and the gate 56 is closed. The command signal S is applied to the converter circuit 42 and is converted by the circuit 42 into a 3-bit binary signal. The respective bits are coupled through the gate 52, the external connector terminals 22, 24 and 26 and the connectors 12, 14 and 16, respectively, to the oscillator selector 69 in the oscillator block 60. In accordance with the content of the binary signal, the oscillator selector 69 selects one of the oscillators 61–68 and couples the output clock signal from the selected oscillator to the internal display control circuit in the display control block 50 via the connector 18, the external connector terminal 28, and the gate 54. It is apparent that the number of oscillators in the oscillator blocks 60 can be larger than the number of the external connector terminals of the display control block 50.

When the oscillator block 70 of FIG. 5 is connected to the display control block 50 of FIG. 2, the gate control signal GS=1 is applied to place the display control block 50 in the second mode of operation. Thus, the gates 52 and 54 are opened and the gate 56 is closed. A 3-bit binary signal produced by the converter circuit 42 from the command signal S is applied through the gate 52, the external connector terminals 22, 24 and 26, and the connectors 12, 14 and 16 to the oscillator selector 79 in the oscillator block 70. In accordance with the information borne by the 3-bit binary signal, the oscillator selector 79 selects a designated one of the oscillators 71–78 so that only the selected oscillator can be supplied with operating current. The clock signal generated by the thus selected and powered oscillator is coupled through the connector 18, the external connector terminal 28 and the gate 54 to the internal display control circuit in the display control block 50. This arrangement is advantageous in that the number of oscillators can be larger than the number of the external connector terminals and also in that power consumption can be kept low because only type of the oscillators is operated.

Figure 6:
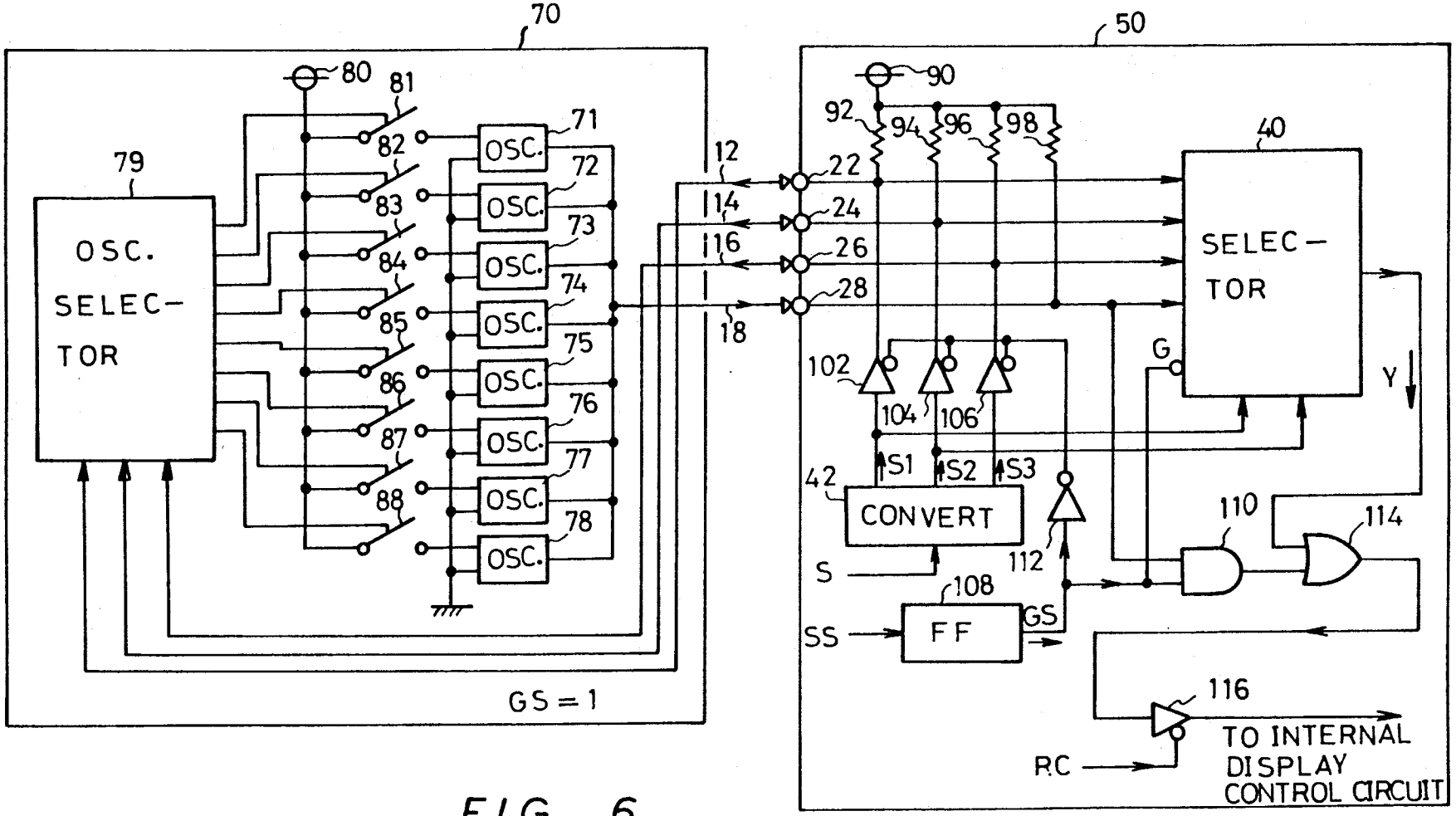
FIG. 6 is a detailed circuit diagram of a combination of the display control block shown in FIG. 2 with the oscillator block shown in FIG. 5.

FIG. 6 shows in a greater detail the combination of the display control block 50 shown in FIG. 2 and the oscillator block 70 of FIG. 5. The external connector terminals 22, 24, 26 and 28 of the display control block 50 are connected to the selector 40, and also coupled through associated pull-up resistors 92, 94, 96 and 98, respectively, to a power supply 90. The output of the converter circuit 42 which converts the command signal S into a 3-bit binary signal comprising three bits S1, S2 and S3 is applied through three-state buffer circuits 102, 104 and 106 to the external connector terminals 22, 24 and 26, respectively, and, at the same time, two of the three bits, namely, S1 and S2 are applied as a selection signal to the selector 40.

When the oscillator block 70 or 60 shown in FIG. 5 or 4 is connected through the external connector terminals 22–28, a mode selection signal SS is manually applied to a flip-flop 108. (Alternatively, the signal SS may be internally generated within the system.) Then, the flip-flop 108 generates the gate control signal GS (GS=1). On the other hand, an oscillator block of the type shown in FIG. 3 is connected via the external connector terminals 22–28, the signal SS is not applied to the flip-flop 108 and, therefore, no gate control signal is developed at the output of the flip-flop 108 (i.e. GS=0), which places the apparatus in the first mode of operation. Only when the mode selection signal SS is applied, the gate control signal GS is developed and the apparatus is placed in the second mode of operation. The gate control signal GS is applied to a ground terminal G of the selector 40 to render it inoperative. The signal GS is also applied to an AND gate 110 to open it. Further, the gate control signal GS is applied to an inverter 112 and the inverted version of the signal GS is applied to the three-state buffer circuits 102, 104, 106 as a control signal so that they can pass the respective three bits S1, S2, S3 of the binary signal.

The external connector terminal 28 is connected to an input of the AND gate 110. The output of the AND gate 110 is applied to the internal display control circuit (not shown) through an OR gate 114 and a three-state buffer circuit 116. The output signal Y from the selector 40, which is developed only when an oscillator block of the type shown in FIG. 3 is used, is also coupled to the internal display control circuit through the OR gate 114 and the three-state buffer circuit 116. The conduction of the three-state buffer circuit 116 is controlled by a signal RC similar to the signal RC used in the circuit of FIG. 1. The three-state buffer circuit 116 is conductive when the signal RC at a low level is applied to it.

One of switches 81, 82, . . . , 88 of the oscillator block 70 is closed in response to the output of the oscillator selector 79 to which the bits S1, S2 and S3 of the selection signal are coupled through the external connector terminals 22, 24 and 26 and the connectors 14, 16 and 18, respectively. The oscillators 71–78 are coupled through the switches 81–88 to the power supply 80. Thus, only that oscillator which is powered through the closed switch oscillates.

When the oscillator block 70 is coupled to the display control block 50 as shown in FIG. 6, the mode selection signal SS is applied to the flip-flop 108 which converts the signal SS into a corresponding gate control signal GS (GS=1) which places the display control block 50 in the second operating mode. In the second operating mode, the three-state buffer circuits 102, 104 and 106 are rendered conductive, the selector 40 is disabled, and the AND gate 110 is rendered conductive. In the display control block 50 shown in FIG. 2, the gate 56 is used separate from the selector 40, but, in the arrangement of FIG. 6, the single selector 40 achieves the functions of both of the selector 40 and the gate 56 of FIG. 2 by virtue of using the selector 40 with a ground terminal G of which the potential is varied to render the selector 40 operable or inoperable.

Let it be assumed that a command signal S comprising five pulses, for example, is applied to the converter circuit 42. The bits S1 and S3 of the binary signal from the converter 42 are "1" (high level) and the bit S2 is "0" (low level). These bits S1, S2 and S3 are coupled through the three-state buffer circuits 102, 104 and 106, the external connector terminals 22, 24 and 26, and the connectors 12, 14 and 16, respectively, to the oscillator selector 79, and the selector 79 closes the switch 86 to select the oscillator 76. Thus, the oscillator 76 is powered from the power supply 80 into operation. The clock signal generated by the oscillator 76 is applied through the connector 18, the external connector terminal 28, the AND gate 110, the OR gate 114 and the three-state buffer circuit 116 to the internal display control circuit.

If it is desired to a clock signal of a different frequency, the level of the control signal RC is changed from low to high to render the three-state buffer circuit 116 non-conductive, a different command signal S is applied to the converter circuit 42 to select that oscillator which generates the clock signal at the desired frequency, and the control signal RC is returned to the low level.

When the conventional type oscillator block 10 shown in FIG. 3 is coupled to the display control block 50 shown in FIG. 6, the mode selection signal SS is not applied to the flip-flop 108. This causes the system to be placed in the first operating mode. In the first operating mode, no gate control signal GS or a gate signal GS=0 is generated. Accordingly, the three-state buffer circuits 102, 104 and 106 and the AND gate 110 are maintained close, and the selector 40 is operable.

The three-bit binary signal comprising three bits S1, S2 and S3 provided by the converter 42 is not transmitted to the oscillator block 10, but only the bits S1 and S2 are coupled to the selector 40 which selects one of the clock signals generated by the oscillators 1–4 designated by the command signal S. The selected clock signals is coupled, as an output Y of the selector 40, to the internal display control circuit through the OR gate 114 and the three-state buffer circuit 114. The clock signal generated by the oscillator 4 entering into the display control block 50 via the external connector terminal 28 is not coupled directly to the internal display control circuit through the AND gate 110, because the AND gate 110 is closed.

When the oscillator block 60 shown in FIG. 4 is coupled to the display control block 50 of FIG. 6, the mode selection signal SS is applied to the flip-flop 108, as in the case of the oscillator block 70, so that the system is placed in the second mode. The gate control signal GS is generated so as to render conductive the three-state buffer circuits 102, 104 and 106 and the AND gate 110 and render the selector 40 inoperable.

Then, one of the oscillators 61–68 corresponding to the number of pulses in the command signal S applied to the converter 42 is selected by the oscillator selector 69. The clock signal from the selected oscillator is coupled through the connector 18, the external connector terminal 28, the AND gate 110, the OR gate 114 and the three-state buffer circuit 116 to the internal display control circuit.

In the description thus far made, the number of the terminals of the display control block for connection to the oscillator block has been described to be four, but the number is not limited to four. When the number of the external connector terminals is three, four clock signals can be selected. With five external connector terminals, as many as sixteen clock signals can be selected.

As described above in detail, since the number of selectable clock signals for a display control block according to the present invention can be greater than the number of terminals required for coupling different oscillators to the display control block, fabrication of the display control block in an integrated circuit form becomes easier. Furthermore, the display control block according to the present invention can be used with a conventional oscillator block, and, thus, it has wider utility. In addition, when the display control block of the present invention is used, ON-OFF control of respective oscillators in a oscillator block is possible and, accordingly, power consumption can be reduced.

What is claimed is:

1. A display control apparatus for selectively providing a plurality of clock signals at different frequencies for selectively driving a plurality of different type display devices which operate at different clock signal frequencies, comprising:

a display control block having a plurality of external connector terminals connected to an oscillator block;

said oscillator block including connector means to coupled to individual external connectors of said plurality of external connector terminals and including a plurality of oscillators having different oscillation frequencies;

said oscillator block being one of a first oscillator block type and a second oscillator block type;

first gating means for coupling a predetermined one of said external connector terminals to an internal display control circuit;

selection signal generating means for generating a plural-bit binary selection signal for selecting one of said oscillators in said oscillator block;

a selector connected to said external connector terminals, for selecting one of said external connector terminals in accordance with the selection signal applied thereto from said selection signal generating means;

second gating means for coupling the external connector terminal selected by said selector to said internal display control circuit;

third gating means for coupling the selection signal from said selection signal generating means to remaining external connector terminals other than said predetermined external connector terminal; and gate control means for closing said first and third gating means and opening said second gating means, and for opening said first and third gating means and closing said second gating means such that a functional interface exist between said oscillator block of said first oscillator block type and said second oscillator block type, respectively.

2. A display control apparatus according to claim 1 wherein the oscillators in said first oscillator block type are normally oscillating, with their outputs being coupled to said connector means.

3. A display control apparatus according to claim 1 wherein the oscillators in said second oscillator block type are normally oscillating, and said oscillator block further includes an oscillator selector for selecting one of said oscillators and coupling an oscillation signal of the selected oscillator to said connector means connected to said predetermined external connector terminal, said selection signal for controlling the selecting operation of said oscillator selector being coupled to said oscillator selector via said connector means connected to said remaining external connector terminals.

4. A display control apparatus according to claim 1 wherein said second oscillator block type includes selecting means for selecting one of said oscillators to which operating current is to be supplied, the outputs of all of said oscillators being coupled to said connector means connected to said predetermined external connector terminal, and said selection signal for controlling the selecting operation of said selecting means is coupled to said selecting means via said connector means connected to said remaining external connector terminals.

* * * * *